United States Patent [19]

Bulso, Jr. et al.

[11] Patent Number: 4,549,424

[45] Date of Patent: Oct. 29, 1985

[54] SHELL TOOLING METHOD

[75] Inventors: Joseph D. Bulso, Jr., Canton, Ohio; Stephen D. Doyle, Knoxville, Tenn.; James A. McClung, North Canton, Ohio

[73] Assignee: Redicon Corporation, Canton, Ohio

[21] Appl. No.: 657,831

[22] Filed: Oct. 5, 1984

Related U.S. Application Data

[62] Division of Ser. No. 503,343, Jun. 10, 1983, Pat. No. 4,516,420.

[51] Int. Cl.[4] ..... B21D 28/02

[52] U.S. Cl. ..... 72/329; 72/336; 72/339; 413/56

[58] Field of Search ..... 72/327–329, 72/330, 335, 336, 339, 347–350; 413/56

[56] References Cited

U.S. PATENT DOCUMENTS

| | | | |
|---|---|---|---|
| 2,763,228 | 9/1956 | Lawson . | |
| 3,405,546 | 10/1968 | Hoffman et al. . | |
| 3,695,084 | 10/1972 | Siemonsen et al. | 72/348 |
| 3,768,295 | 10/1973 | Cudzik | 72/347 |
| 3,786,667 | 1/1974 | Garnett, Jr. | 72/348 |
| 3,902,347 | 9/1975 | Ridgeway et al. | 72/336 |
| 3,980,297 | 9/1976 | Bulso, Jr. et al. | 271/269 |
| 4,214,471 | 7/1980 | Bulso, Jr. et al. | 72/349 |
| 4,316,379 | 2/1982 | Andersen | 72/347 |
| 4,343,173 | 8/1982 | Bulso, Jr. et al. | 72/345 |
| 4,372,720 | 2/1983 | Herdzina et al. | 413/56 |
| 4,416,140 | 11/1983 | Bulso, Jr. et al. | 72/347 |
| 4,442,691 | 4/1984 | Grow et al. | 72/329 |

*Primary Examiner*—Daniel C. Crane
*Attorney, Agent, or Firm*—Reese Taylor

[57] ABSTRACT

A method and apparatus for forming end panels or shells for two-piece cans includes incorporation of the tooling necessary to form the panel within a double acting press. The tooling includes a fluid actuated hold down sleeve, carried by the outer slide of the press, which is capable of being moved into holding engagement with the metal from which the panel is formed. The inner slide of the press carries a punch which is movable into forming engagement with the metal and the outer slide carries tooling which is capable of blanking the metal against a cut edge carried by the fixed lower platen of the press. The chuck wall of the end panel is then preliminarily formed by the action of the punch drawing the blank around the fixed radius of a die core member fixedly carried by the bottom press platen. Further downward movement of the punch drapes the metal about the radius just referred to and finally sets the chuck wall against a fluid supported cushioning member carried by the lower platen so that, in effect, a reverse draw about the periphery of a fixed die core center is achieved. The method of this invention includes utilization of the apparatus just described and primarily relates to the cushioning and reverse draw action for finally setting the chuck wall.

2 Claims, 7 Drawing Figures

SHELL TOOLING METHOD

RELATED APPLICATIONS

This application is a division of application Ser. No. 503,343, filed June 10, 1983, now U.S. Pat. No. 4,516,420.

BACKGROUND OF THE INVENTION

This invention relates, in general, to forming end panels for two-piece containers from a blank of metal and relates, in particular, to forming such end panels in double acting presses employing a cushioned reverse draw concept to set the chuck wall.

DESCRIPTION OF THE PRIOR ART

End panels for two-piece or, for that matter, for three-piece metal containers are well known in the art. It is of critical importance in forming these panels to control metal thickness. With regard to all types of end panels, which have various radiused areas, it is important to avoid thinning of the metal in these areas and, thus, to avoid weakening of the piece. In conventional processes, it is thought to be necessary to compensate for the natural thinning phenomena by using metal with sufficient base weight so that the finished product will still have sufficient strength. Therefore, a method which enables the base weight of the metal to be reduced without diminishing the effectiveness of the final product is desirable. Also, with regard to pull tab cans such as are used primarily with beverages, the tear line must be held to very precise tolerances and, therefore, the metal thickness of the panel is of major importance and the control of this dimension during the forming operation is also important.

At high speeds, the shut height of presses normally employed for forming end panels of this type will change and this height can affect metal thickness. It is, therefore, important to be able to control that shut height, which assists in controlling metal thickness.

In any event, the resulting product which is the subject of the apparatus and method of this application, is not, per se, new. However, it is believed that the method of achieving it with reduced base weight and without reduced strength is.

SUMMARY OF THE INVENTION

It has been found that the above noted objects can be achieved by providing certain unique tooling capable of operation in a double acting press so that the shut height of the press can be effectively controlled and thinning of the metal in the chuck wall, radius areas can also be effectively controlled. It is of critical importance, as noted above, to control the metal thickness and it is believed that utilization of the tooling to be described, in a double acting press, will enable that object to be achieved.

Accordingly, the tooling involved essentially includes a fluid operated pressure hold down which will hold the metal against the bottom platen of the press while a punch, carried by the outer ram of the press, descends to blank the metal against the cut edge.

It has also been found that the tooling advantageously will include a die core ring having a radius about which the chuck wall is first drawn as the punch descends. It has also been found that a fluid supported cushioning member can be employed in the bottom platen to react against the force of the punch during the final setting of the chuck wall. In effect, this fluid supported cushioning means permits an effective reverse draw to be achieved so that the critical groove area adjacent the chuck wall can be formed without unnecessarily thinning the metal. Effectively, a slight "bounce" right at the end of the downward stroke of the punch is achieved and this, combined with wiping of the metal about the radius of the die core ring just referred to, permits the critical radius to be formed without any unnecessary thinning of the metal in the critical area.

Accordingly, production of apparatus for forming end panels and a method of utilizing such apparatus becomes the principal object of this invention with other objects thereof becoming more apparent upon a reading of the following specification considered and interpreted in view of the accompanying drawings.

OF THE DRAWINGS

DESCRIPTION OF THE PREFERRED EMBODIMENT

Figure 1:
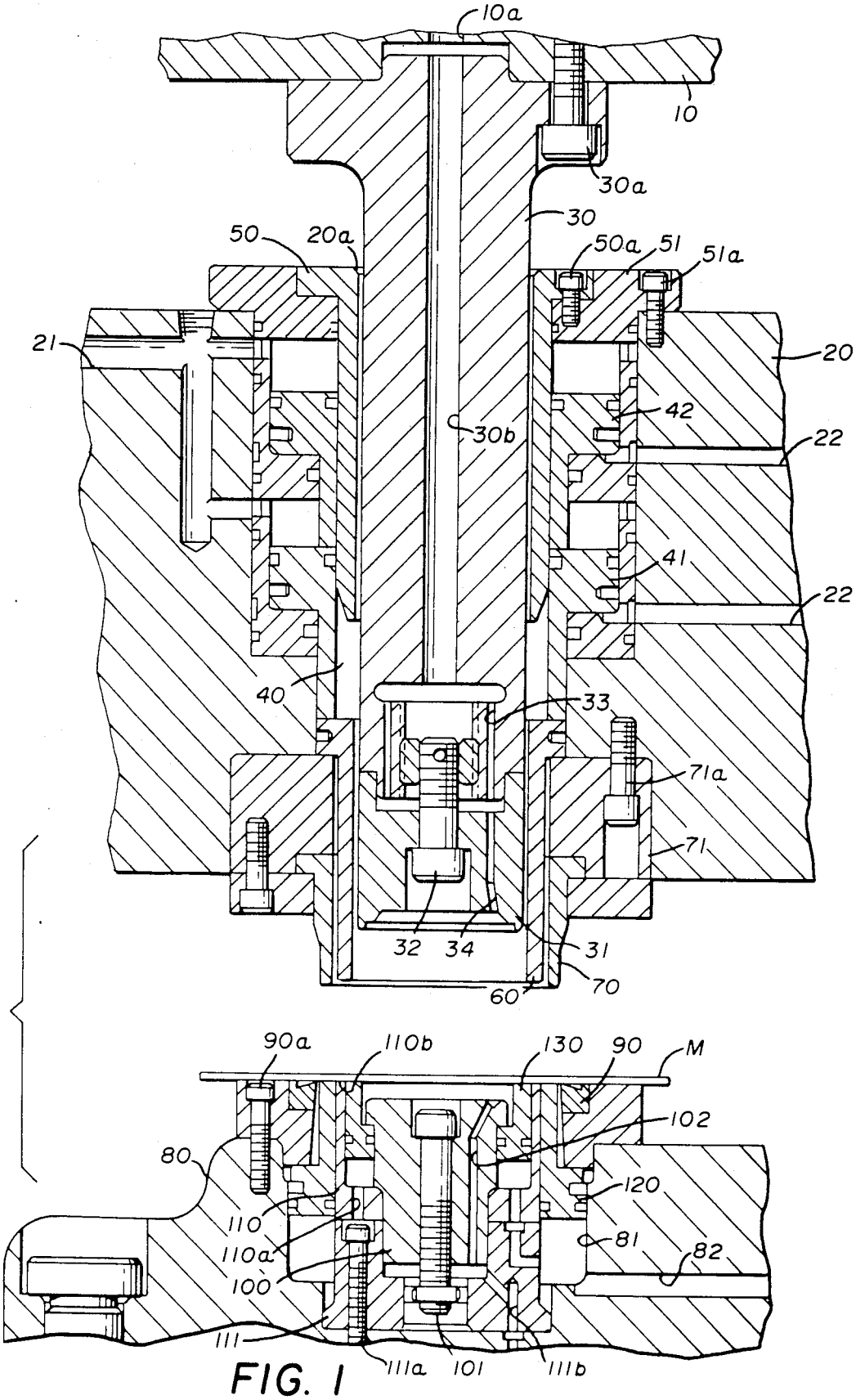
FIG. 1 is an elevational view, partially in section, illustrating the relative positions of the apparatus prior to operation.

Referring first to FIG. 1 of the drawings, it will be understood, as noted above, that the tooling which is the subject of this particular application would be used in a double acting press. No great detail has been illustrated and described herein in connection with the working of a double action press except to point out that the press includes inner and outer slides which operate independently performing dual actions on each opening and closing or cycle of the press, per se. The general scheme of operation of a press of this nature is well known to those having ordinary skill in this art and can be seen in Ridgway U.S. Pat. No. 3,902,347, which also discloses the capability of adjustably controlling the timing and movement of the slides by an adjustable shut height.

Referring still then to FIG. 1 for a description of the relevant components of the apparatus, it will be noted that the upper platen of the press carries an inner slide 10 and an outer slide 20 which are reciprocal with respect to lower platen 80. The outer slide 20 has a through central opening 20*a* for receipt of the tooling carried by the inner slide 10 so that that tooling may reciprocate freely within the opening 20*a*, as will be described.

Still referring to FIG. 1 of the drawings and referring primarily to the inner slide 10 and the tooling carried thereby, it will be noted that a punch center post 30 is mounted on the bottom edge of the inner slide 10 and secured thereto by a plurality of screws 30*a*. The punch center post 30 is elongate with its proximal end secured to slide 10 as just noted and its distal end carrying a punch core 31. The punch core 31 is adjustably secured to the distal end of the punch center post 30 by means of the threaded sleeve assembly 32.

It should also be noted that the punch center post 30 has a through central bore 30*b* which is in fluid communication with a secondary bore 33 which is, in turn, in fluid communication with an air blow off passage 34 in the punch core 31. All of these passages are also in fluid communication with a bore 10*a* in the inner slide 10 which leads to a source of air under pressure (not shown). This arrangement is for purposes of assisting removal of the finished end panel and the particular design and operation of the passage 34 in the punch core 31 can be seen in Bulso U.S. Pat. No. 4,343,173. Suffice it to say here that air may be introduced to dislodge the finally formed panel should it stick to the punch core 31.

The apparatus just disclosed, namely the punch center post 30 and the punch core 31, are, as noted, secured to the inner slide 10 and move in conjunction therewith as that slide moves toward and away from the bottom platen 80 of the press.

Still referring to FIG. 1 and referring particularly to the outer slide 20, it will be noted that, as already mentioned, the outer slide 20 does have a central opening 20*a*. Surrounding this opening 20*a* is an upper cylinder 40 within which a sleeve 50 is disposed. The sleeve 50 is secured to a cap 51 by screws 50*a* with the cap 51 being, in turn, secured to the outer slide 20 itself by screws 51*a*.

Also received within the upper cylinder 40, which is formed by the sleeve 50 and the walls of the opening 20*a* of the outer slide 20, are first and second stacked pistons 41 and 42, respectively.

Furthermore, a passage 21 is provided in the outer slide 20 for communication with the upper cylinder 40 for the introduction of fluid under pressure into the cylinder so that it may act upon the pistons 41 and 42, as will be described. Radially directed passages 22,22 are also provided for relief of this fluid. The source of the fluid pressure for passage 21 is not illustrated.

Continuing with reference to FIG. 1 of the drawings, it will be noted that a pressure sleeve 60 is also carried by the outer slide 20. This pressure sleeve is movable relatively of the slide 20 and is acted upon by the stacked pistons 41,42 under fluid pressure through the passage 21 into the upper cylinder 40.

Outer slide 20 also includes a punch shell assembly 70 which is mounted on the slide by the retainer 71 which is, in turn, held in place by screws 71*a*. This punch shell assembly 70 is disposed in surrounding or concentric relationship with the pressure sleeve 60 as is apparent from FIG. 1 of the drawings.

Still referring to FIG. 1 of the drawings and paying particular attention to the bottom platen 80 of the press, it will be noted that this platen includes a central recess 81. Fluid passages and air passages 82 and 83 are also provided in the platen 80 for purposes which will be described.

Also mounted on the bottom platen 80 is a cut edge 90 which is mounted in overlying relationship with the central recess 81 and held onto the platen by screws 90*a*.

Also carried on the bottom platen 80 and within the central recess 81 is a die core 100. This die core 100 is fixed to and mounted on the bottom platen 80 by means of a threaded sleeve 101 ans has a through air blow off passage 102 similar to passage 34 of punch core 31 for purposes which will be described below.

Also received on the bottom platen 80 within the recess 81 is a die core ring 110 which rests on a die core ring riser 111 which is, in turn, secured to the bottom platen by screws 111*a*. The die core ring riser 111 has a fluid passage 111*b* and the die core ring 110 also has a fluid passage 110*a* for purposes which will be described.

A pressure sleeve 120 is also received on the bottom platen beneath the cut edge 90 and within the recess 81. Effectively, the pressure sleeve 120 is received within a cylinder formed by the walls of the recess 81 and the die core ring and die core riser 110 and 111 respectively.

Finally, a knock out piston 130 is received interiorly of the die core ring 110 within a cylinder effectively formed by the inner walls of the die core ring 110 and the outer wall of the die core 100.

In use or operation of the improved tooling, it will first be assumed that the components are assembled to the position shown in FIG. 1, which is the "open" position of the inner and outer slides 10 and 20. The material from which the end panel is to be formed, generally designated by the letter M, is then placed in the press in the position shown in FIG. 1 of the drawings. The means for feeding or loading the press are not illustrated in detail since such devices are known to those of ordinary skill in the art. An example can be seen in Bulso U.S. Pat. No. 3,980,297.

Figure 2:
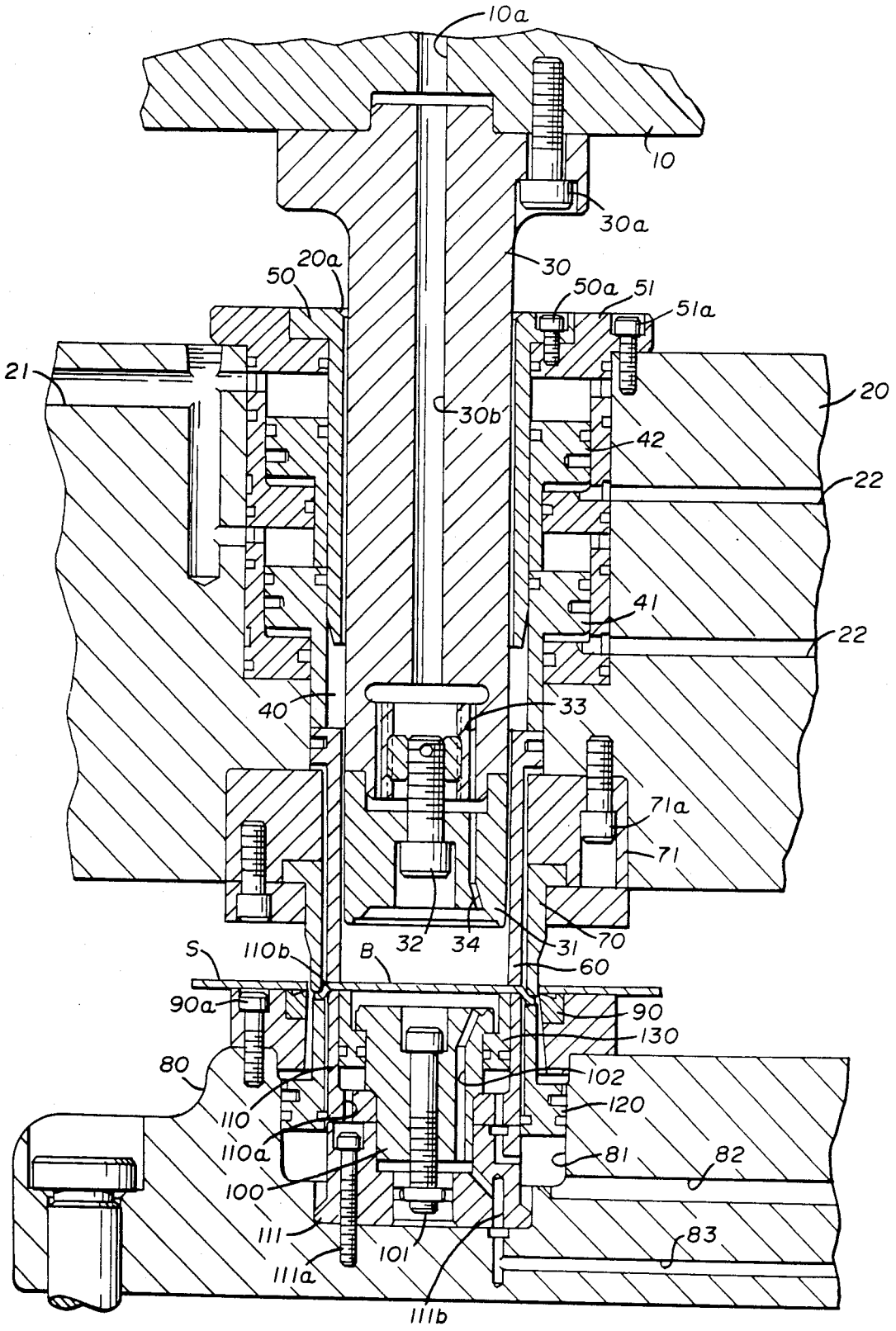
FIG. 2 is a view similar to FIG. 1 showing the relative positions of the components of the apparatus following blanking.

Closing of the press moves both the inner and outer slides 10 and 20 down toward the bottom platen 80 or from the position of FIG. 1 to that of FIG. 2. Contact is first made with the material M by the punch shell assembly 70 to initiate the blanking operation, following which the pressure sleeve system is actuated. To activate the pressure sleeve 60, fluid pressure is introduced through passage 21 into upper cylinder 40. This pressure forces the stacked pistons 41 and 42 down and they, in turn, engage sleeve 60 to move it into holding engagement with the material M. This serves to hold the material M during a portion of the blanking operation and during subsequent operations with the operative position of the pressure sleeve 60 being seen in FIG. 2 of the drawings.

Still referring to FIG. 2, movement of the press brings the punch shell assembly 70 into contact with the material M and as the distal end of the punch shell assembly 70 passes the die line, it will, in cooperation with cut edge 90, sever or blank the material M into two pieces, one of which may now be described as the blank B and the other may be described as the scrap S. At the same time, preliminary forming of blank B around the radius 110*b* of the top of die core ring 110 occurs.

Figure 3:
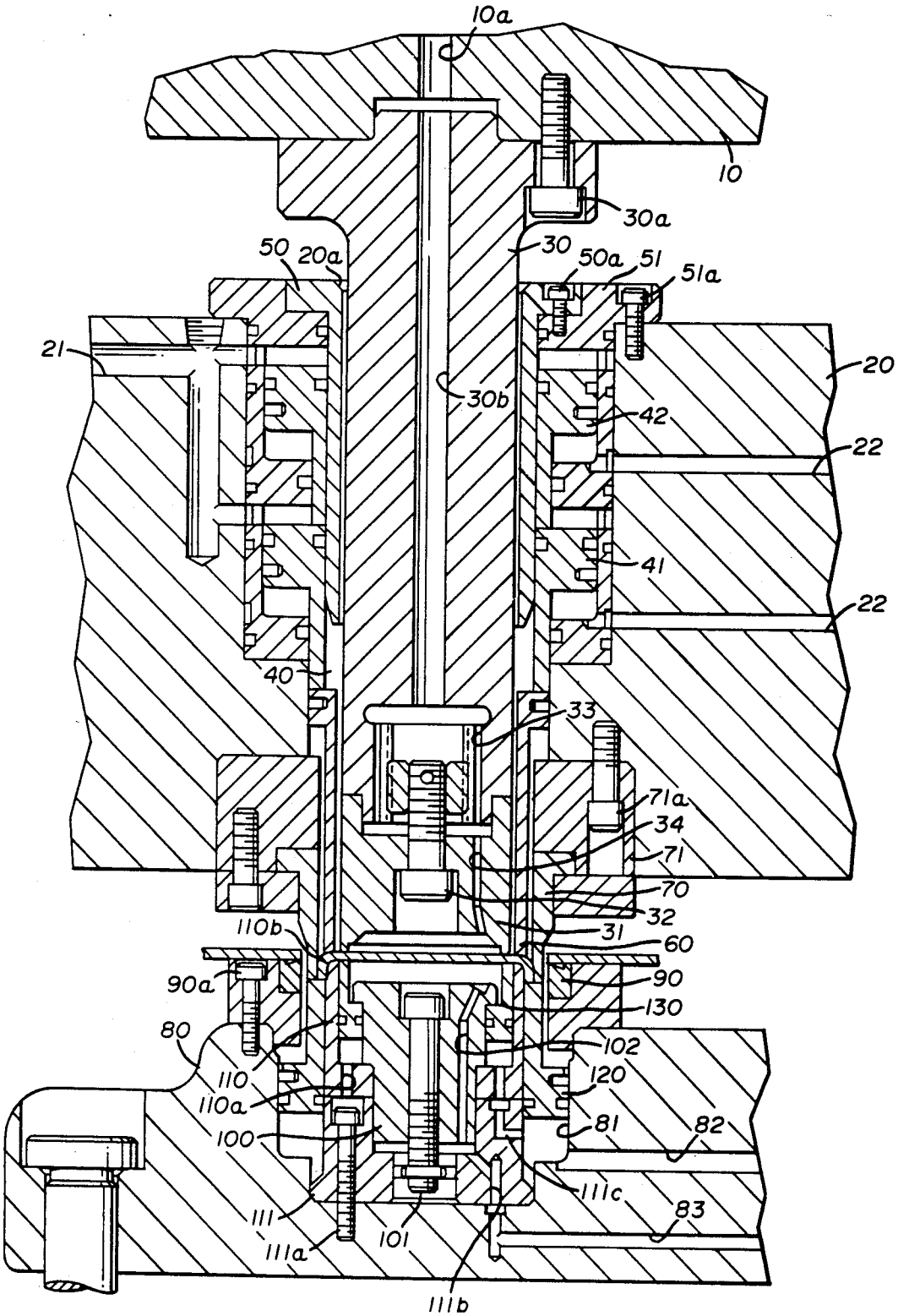
FIG. 3 is a view similar to FIG. 1 showing the relative positions of the elements of the apparatus following wiping.

Further downward movement of the inner slide 10 will cause the punch shell assembly 70 to wipe the peripheral edges of the blank B about radius 110*b* on the projecting end of the die core ring 110, as shown in FIG. 3 of the drawings. It will be noted at this point that the pressure sleeve 60 does not descend any further since the resistance of the die core ring 110 is such that the pistons 41 and 42 tend to back up, overcoming the fluid pressure from the passage 21. Thus, die core ring 110 is supported on die core riser 111 and at this stage that fixed support will prevent further downward movement of pressure sleeve 60.

Figure 4:
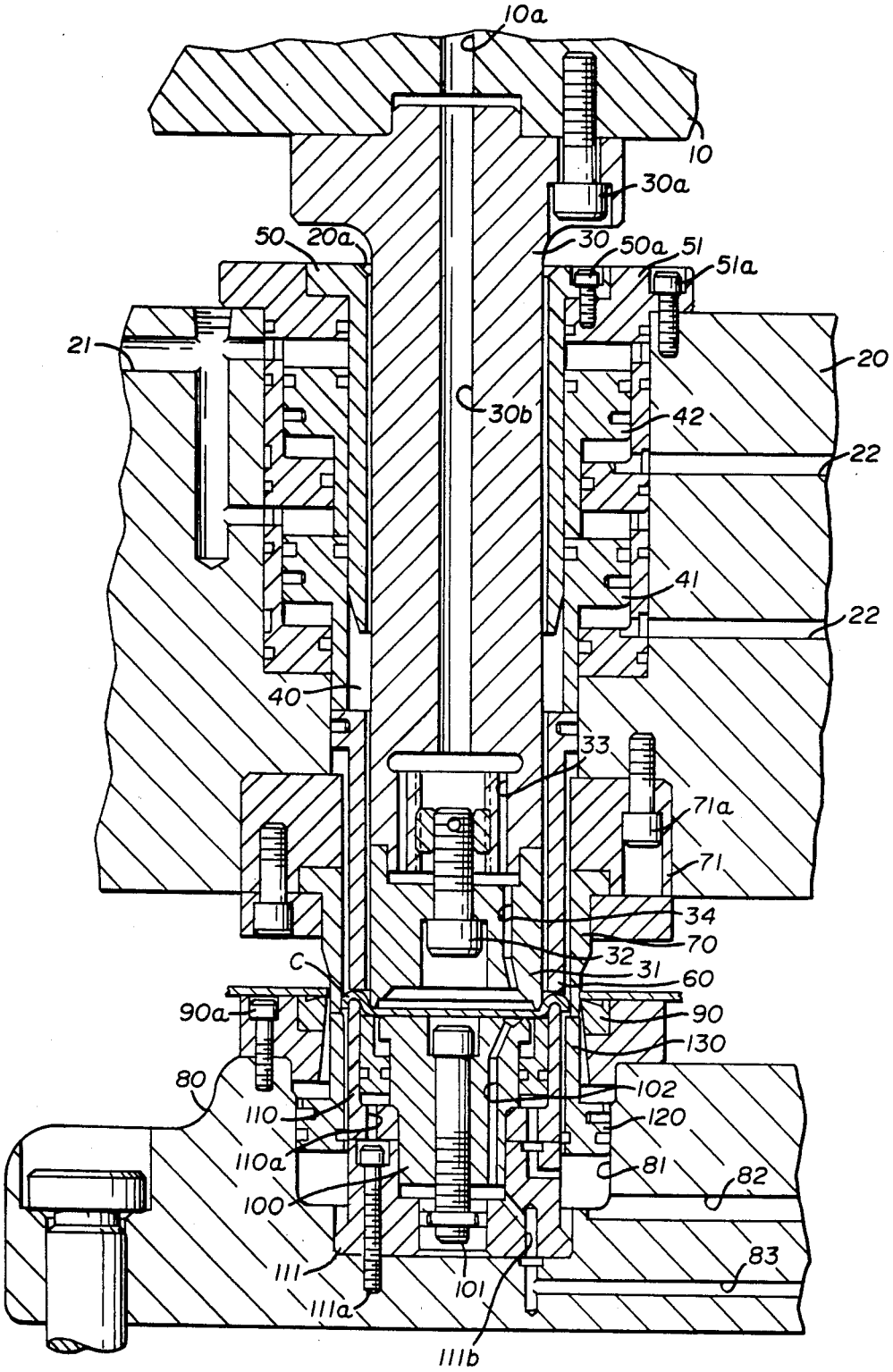
FIG. 4 is a view similar to FIG. 1 showing the relative positions of the components of the apparatus after initial forming of the end panel.

As the inner slide 10 continues its downward movement punch core 31 passes the top of die core ring 110 or, in other words, passes below the tin line. The chuck wall C is thus formed on the blank B by virtue of the fact that punch shell assembly 70 wipes the outboard edge of the blank B over the end of the fixed die core ring 110 as noted and as can be seen in FIG. 4.

Upon further downward movement (see FIG. 5) of the inner slide 10 at this time, it will be noted that pressure sleeve 60 still contacts the metal opposite the top of die core ring 110. As punch core 31 descends, the metal is drawn further down over the radius 110*b*. At the same time the die core 100, which is fixed, supports the central portion of blank B. The pressure of the periphery of punch core 31 will overcome the pressure acting on the bottom of the knock out piston 130 through bore 110*a* and 111*c*, thereby forcing it downward within its cylinder. This provides a cushioning effect and groove G is set against this cushion.

Figure 5:
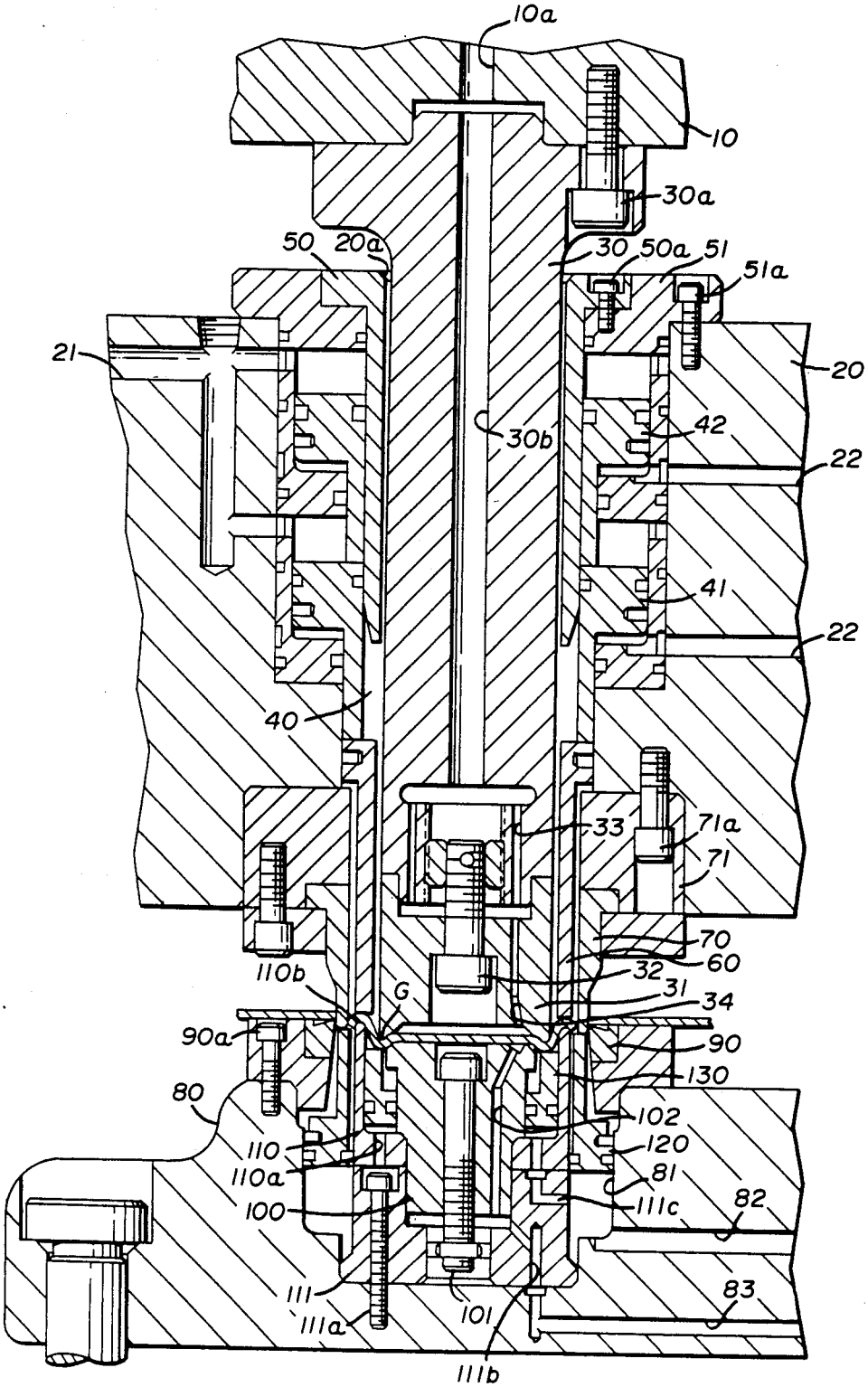
FIG. 5 is a view similar to FIG. 1 showing the relative positions of the elements of the apparatus following final forming of the end panel.

At this point, the blank B has received the configuration of FIG. 5 of the drawings, which is essentially its final configuration at this stage in the overall manufacturing process.

Figure 7:
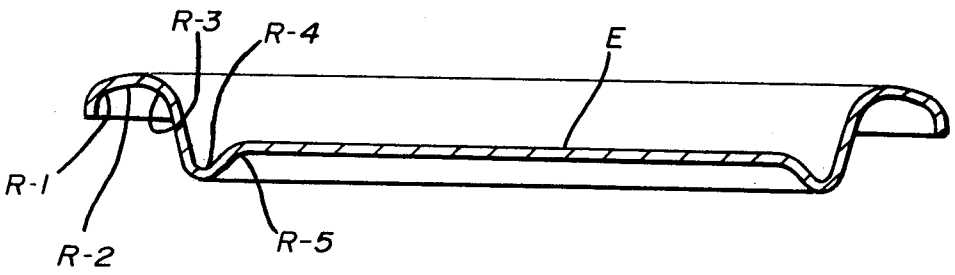
FIG. 7 is an enlarged sectional view showing the critical radius areas of the end panel.

With reference to FIG. 7 of the drawings, it will be seen how an end panel of this type can thus be formed without undue thinning of the metal.

Thus, the critical radius areas R-1, R-2, R-3, R-4 and R-5 are maintained at their desired thickness and the base weight can be reduced. For example, common practice has been to allow about 0.002 inches for thinning in these areas while the present method has been found satisfactory with an allowance of between 0.0004 and 0.0005 inches. When the large numbers of pieces normally produced by tooling of this type are considered, this represents a significant material savings.

Figure 6:
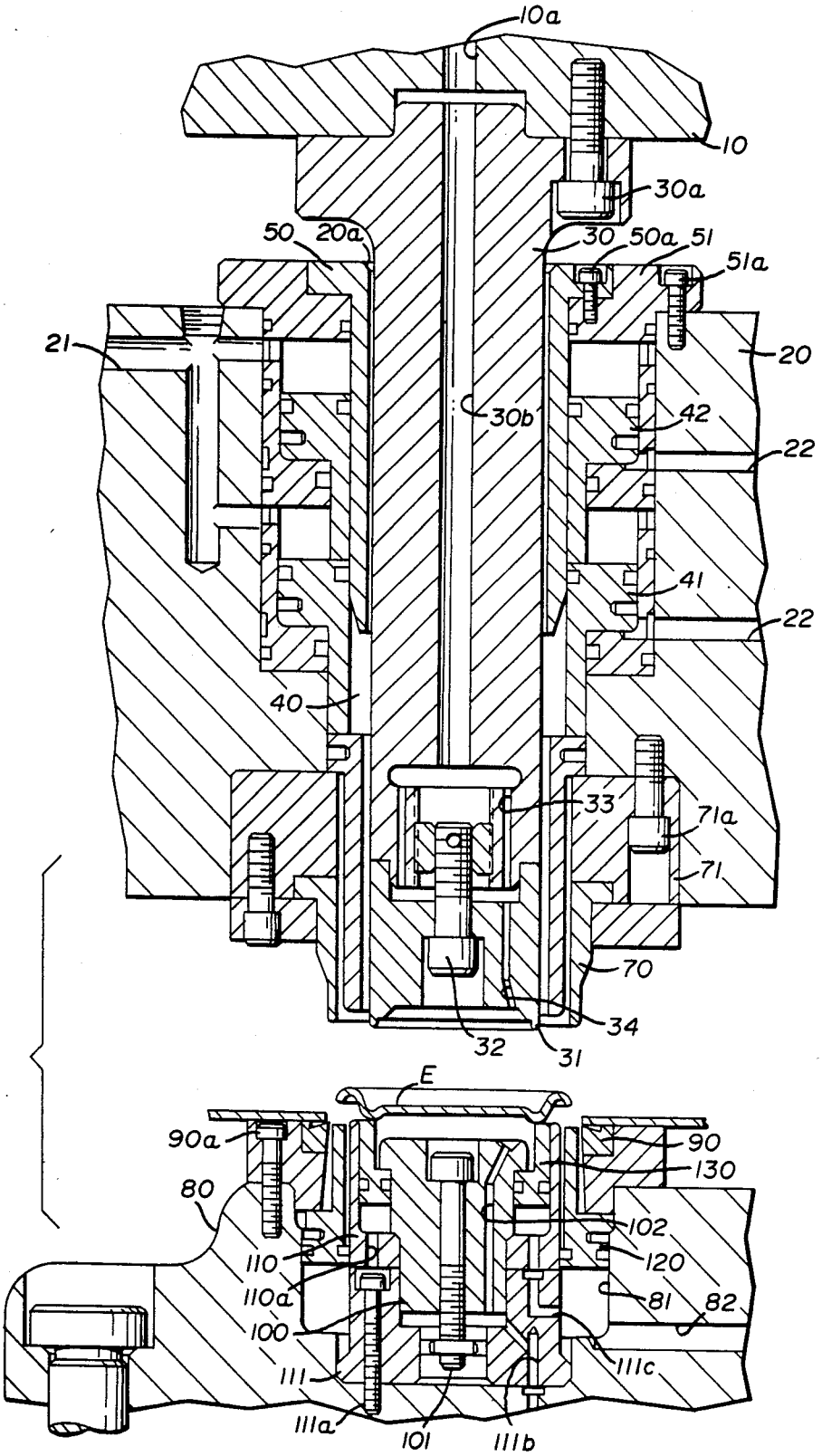
FIG. 6 is a view similar to FIG. 1 showing the relative positions of the elements of the apparatus following retraction of the upper platen and prior to removal of the formed end panel from the press.

After the panel is thus formed and the press bottoms out, both the inner and outer slides 10 and 20 are retracted from the position of FIG. 5 to the position of FIG. 6. Once contact with the finally formed can end panel E is released by the punch core 31, the knock out piston 130 moves back upward toward the die line under fluid pressure transmitted from the passage 82 of the bottom platen through the passage 111*c* of the die core ring riser 111 and through the passage 110*a* of the die core ring 110. This raises the can end panel E to the die line from which position it may be removed from the press and transferred to the next station or to the next press for further operations thereon such as, for example, scoring the tear line and attaching the rivet, etc.

During removal, if the panel E should stick to punch core 31, actuation of air through passage 34 will dislodge it. Similarly, if the panel should resist removal from die core 100, actuation of air through passages 102 and 111*b* will dislodge it.

While a full and complete description of the invention has been set forth in accordance with the dictates of the Patent Statutes, it should be understood that modifications can be resorted to without departing from the spirit hereof or the scope of the appended claims.

Thus, it will be noted that only one set of tooling has been illustrated while, in practice, it will be understood that multiple sets would be employed in the press so that a plurality of can end panels E would be produced in each press cycle.

Also, while certain U.S. Patents have been referred to to illustrate various known components, it will be understood that these are intended to be illustrative only and the invention is not limited to their specific use.

However, the use of some sort of double acting press is considered important due to the enhanced control available over the critical shut height adjustment which is essential in dealing with the close tolerances involved.

What is claimed is:

1. A method of forming an end panel for a two-piece container from a piece of metal in a double acting press comprising the steps of:

(A) engaging the metal with a sleeve under fluid pressure;

(B) blanking the metal against a cut edge to form a panel;

(C) wiping the panel against a fixed die core ring with a punch shell which telescopes over the die core ring to form a peripheral flange on the panel;

(D) initially forming a chuckwall in the panel by engaging the central portion thereof with a punch core;

(E) finally setting the chuckwall by drawing the panel over the die core ring by further movement of the punch core while (1) supporting the panel with a fluidly supported piston beneath the chuckwall area in opposed relationship to and in cooperation with the punch core;

(2) holding pressure on the top of the panel against the die core ring, and (3) supporting the peripheral flange of the panel between the periphery of the punch shell and the periphery of the die core ring.

2. The method of claim 1 wherein said blanking step includes initiating the blanking operation followed by engagement of the metal under fluid pressure and final blanking.

* * * * *